US005779421A

United States Patent [19]

Beck et al.

[11] Patent Number: 5,779,421

[45] Date of Patent: Jul. 14, 1998

[54] INSULATION FASTENING DEVICE

[75] Inventors: Harald Beck, Schaan, Liechtenstein; Remo Kluser, Hinterforst, Switzerland

[73] Assignee: Hilti Aktiengesellschaft, Schaan, Liechtenstein

[21] Appl. No.: 855,348

[22] Filed: May 13, 1997

[30] Foreign Application Priority Data

May 14, 1996 [DE] Germany ..... 196 19 318.4

[51] Int. Cl.[6] ..... F16B 15/02; F16B 43/00

[52] U.S. Cl. ..... 411/480; 411/531; 411/533; 411/908; 52/410

[58] Field of Search ..... 411/368, 451, 411/469, 480, 531, 533, 908; 52/410, 512

[56] References Cited

U.S. PATENT DOCUMENTS

| | | | |
|---|---|---|---|
| 5,118,235 | 6/1992 | Dill | 411/533 X |
| 5,171,118 | 12/1992 | Rothenbuhler | 411/533 X |
| 5,607,272 | 3/1997 | Olvera et al. | 411/533 |
| 5,626,451 | 5/1997 | Seibert | 411/531 X |
| 5,671,576 | 9/1997 | Kluser | 411/533 X |

*Primary Examiner*—Neill R. Wilson

*Attorney, Agent, or Firm*—Anderson, Kill & Olick, P.C.

[57] ABSTRACT

A device for fastening an insulation element to a constructional component and including a large-surface head (1); a hollow shank (2) projecting from the head (1) and having an inner space which is freely accessible from an opening (15) provided in the head (1), for receiving a fastening member (3), and a lid supported on the head and pivotable about an articulation axis (16, 17) located outside of the opening (15), for closing the opening with the lid engaging, in its closed position, a projection extending from a head surface extending parallel to a cross-sectional surface of the hollow shank (2).

6 Claims, 2 Drawing Sheets

INSULATION FASTENING DEVICE

BACKGROUND OF THE INVENTION

1. Field of the Invention

The present invention relates to a device for fastening an insulation element to a constructional component and which includes a large-surface head, a hollow shank projecting from the head and having an inner space, which is freely accessible from an opening provided in the head, for receiving a fastening member drivable into the constructional component, and a lid supported on the head and pivotable about an articulation axis located outside of the access opening, for closing the opening, with th e lid engaging in its closed position, a projection provided on the head.

2. Description of the Prior Art

A device for fastening of plate-shaped insulation elements to constructional components is known, e.g., from U.S. Pat. No. 5,118,235. The known device has a large-surface head and a hollow shank projecting from the head. A fastening element is inserted into the inner space of the hollow shank through an opening provided in the head. The fastening element is driven into a constructional component with an appropriate tool. In its inserted position, the fastening element is supported on a shoulder of the shank, which is provided in the inner space and faces the setting direction, and extends through the end region of the shank extending in the setting direction.

A plaster material is applied to an insulation element. At that, it is important that no plaster material can penetrate into the shank inner space, as this causes indentation in the surface of the applied plaster layer. If the plaster material penetrates into the inner space, it rises humidity there which can cause corrosion in the fastening element if it is not made of a rust-proof material.

In order to prevent the penetration of the plaster material into the shank inner space, there is provided a lid for closing the opening. This lid is supported on the head and pivots about an articulation axis provided outside of the access opening. The lid cooperates with a projection extending from an inner wall of the hollow shank which wall extends parallel to the longitudinal axis of the shank. In the closed position, the side of the lid facing the setting direction abuts the stop edge of the projection which is adjacent to the inner space.

When the opening is being closed or the plaster material is applied, the lid can penetrate so deep into the inner space that the opening is not closed any more, and the penetration of the plaster material in the shank inner space becomes possible.

Accordingly, an object of the invention is a device for fastening an insulation element in which it is insured that the lid remains reliably closed when forces, which are generated by handling of the device or by application of the plaster material, act on the device.

SUMMARY OF THE INVENTION

The objection of the invention is achieved by providing the projection on a surface of the head extending parallel to a cross-sectional surface of the shank.

The head surface, which extends parallel to the cross-sectional surface of the shank and on which the projection is provided, serves as lid stop which prevents the lid, in the lid closed position, from being pressed further into the inner space of the shank. Providing the projection on the stop surface insures its simple and reliable cooperation with the lid when the lid is being moved in the closed position.

In order that the lid does not project beyond the outer surface of the head, which is opposite to the setting direction, the stop surface, advantageously, is formed by a bottom of a recess provided in the head for receiving the lid in its closed position and which at least partially surrounds the access opening.

From manufacturing prospective, it is advantageous to form the projection provided on the bottom as a peg projecting substantially perpendicular from the bottom and form-lockingly engageable in a through-opening provided in the lid. A non-detachable connection of the peg with the lid is advantageously achieved when the peg is stepwise enlarged in a direction opposite to the setting direction and tapers toward its free end, with the largest diameter of the peg exceeding the diameter of the lid opening. The wall thickness of the lid can, at least in the region of the bore cooperating with the peg, correspond to the distance between the shoulder of the stepwise enlargement of the peg and the recess bottom.

In order to be able to insert the tool for driving the fastening element into the hollow shank, the lid advantageously is formed of two lid parts, with the lid parts being attached outside of the head opening and pivotable about respective articulation axes extending parallel to each other. At that, in the open position of the lid, the opposite sides of the lid parts serve as centering means during the insertion of the driving tool.

The surfaces of the lid parts, which face in a direction opposite to the setting direction, can, e.g., be provided with a profiled surface which would insure a better bonding of the plaster material. A better bonding means that tensile forces may act on the lid parts. In order to retain the lid parts in their closed position also when the tensile forces are applied to the lid parts, preferably, at least two pegs are provided on the bottom for each lid part, with the lid part having at least two through-openings in which the two pegs are engageable.

For closing the opening, it is unimportant which of the two lid parts arrives at its closed position first. However, the two lid parts can be displaced into their closed position simultaneously.

BRIEF DESCRIPTION OF THE DRAWINGS

The features and objects of the present invention will become more apparent, and the invention itself will be best understood from the following detailed description of the preferred embodiments when read with reference tot he accompanying drawings, where.

DETAILED DESCRIPTION OF THE PREFERRED EMBODIMENT

Figure 1:
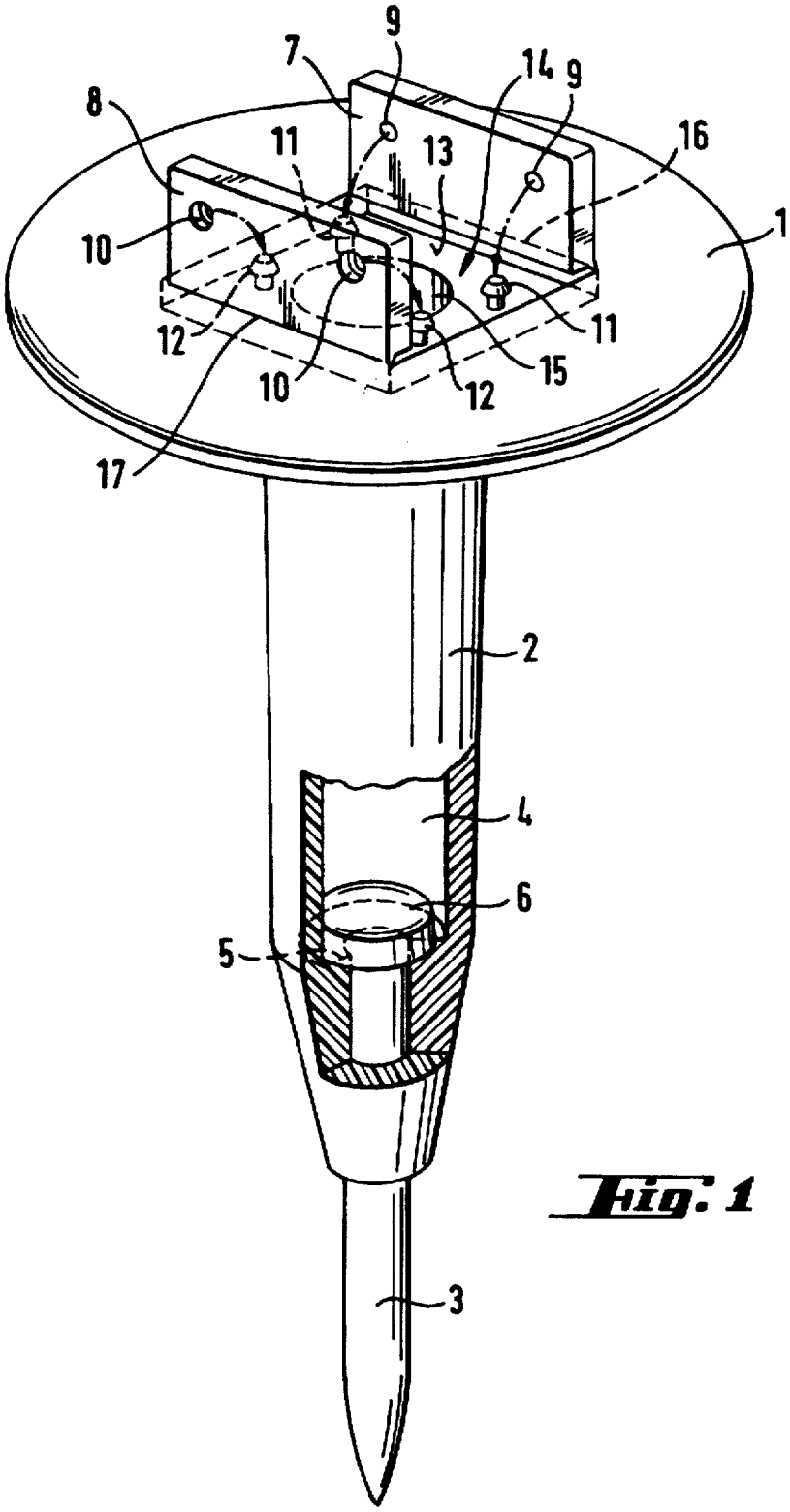
FIG. 1 shows a perspective, partially cross-sectional view of an insulation element fastening device according to the present invention.

The device shown in FIG. 1 is used for fastening of an insulation element (not shown) to a constructional component (likewise not shown). The device is formed of a large-surface head 1 and a hollow shank 2 attached to the head 1. The hollow shank 2 has an inner space 4 which is accessible from outside through an opening 15 formed in the head 1. The inner space 4 serves for receiving of a fastening element 3 with which the device is secured to the constructional component. A stop surface 5, which is provided in the inner space 4 and faces the setting direction, serves as an abutment for a radially enlarged portion 6 of the fastening element 3.

To prevent penetration of a plaster material, which is applied to the fastened insulation element, into the inner space 4 of the hollow shank 2, the opening 15 is closed with two lid parts 7 and 8 of closing lid. In the closed position, the lid parts 7 and 8 are sunk in the recess 14 which is provided in the head 1 and has a bottom 13. The two through-bores 9 and 10 provided in the lid parts 7 and 8, respectively, cooperate, in the closed position of the lid parts 7 and 8, with respective pegs 11 and 12 projecting from the bottom 13.

The two lid parts 7 and 8 are pivotally arranged on the head 1 and pivot about respective articulation axes 16 and 17 which are arranged outside of the opening 15. The recess 14 lies in the projection plane of the opening 15 and is substantially square-shaped. The articulation axes 16 and 17 extend along two opposite sides of the recess 14. The length of the lid parts 7 and 8 measured in a direction parallel to the articulation axes 16 and 17 substantially corresponds to the side length of the recess 14. The length of the lid parts 7 and 8 measured in a direction perpendicular to the articulation axes 16 and 17 substantially correspond to a half of the side length of the recess 14. The wall thickness of the lid parts 7 and 8 substantially corresponds to the depth of the recess 14.

Figure 2:
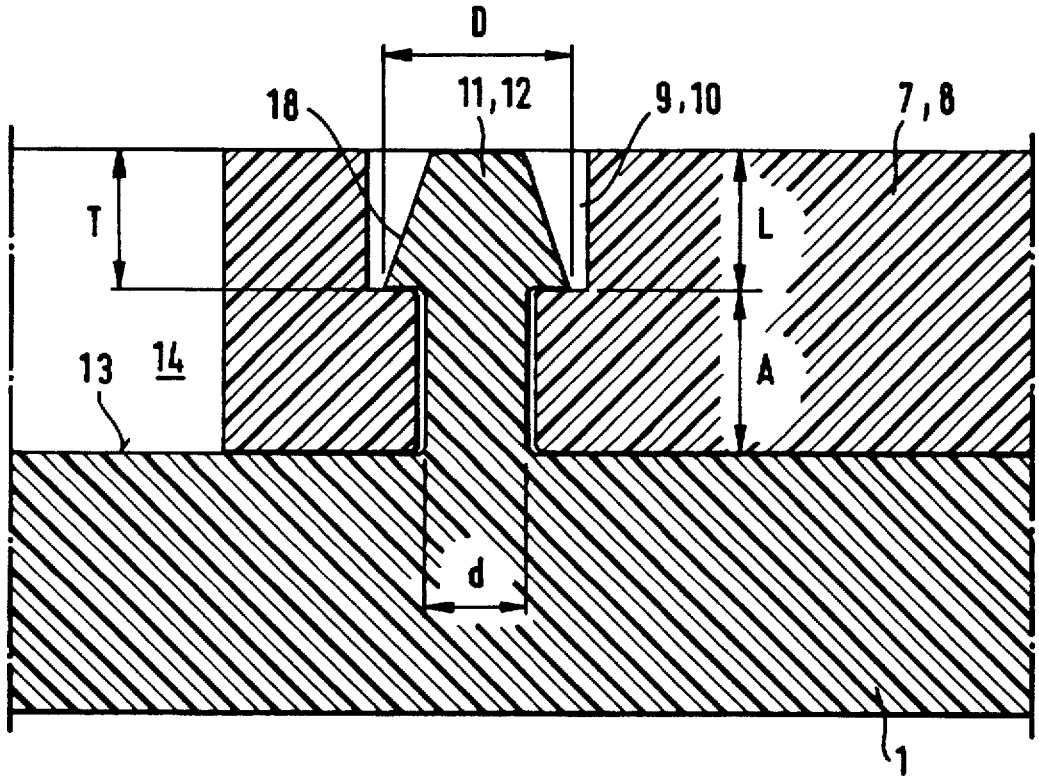
FIG. 2 shows an enlarged cross-sectional view of a form-locking connection of a peg in a through-bore of a lid part.

FIG. 2 shows, at an enlarged scale, how the peg 11, 12 cooperates with the respective bore 9, 10. The bore 9, 10 is formed as a stepped bore, with the larger diameter of the bore 9, 10 being provided in the region of the head 1 facing the setting direction The pegs 11, 12, which project substantially perpendicularly from the bottom 13 of the recess 14, have a stepwise enlargement 18 which tapers toward the free end of the pegs 11 and 12. The distance A between the shoulder of the enlargement 18 and the bottom 13, from which the pegs 11, 12 project, corresponds substantially to the wall thickness of the lid part 7 and 8 reduced by a depth T of the bore region of the respective bores 9 and 10 having a larger diameter. The tapering region of the pegs and 11 and 12 extends over a length L which substantially corresponds to the depth T of the respective bore region of the bores 9 and 10 having a large diameter. The largest diameter D of the pegs 11 and 12 is larger than any portion of the bore 9, 10 having the smaller diameter d.

For closing the opening 15, the lid parts 7 and 8 pivot about their articulation axes. At that, the tapering portions of the pegs 11 and 12, which are arranged outwardly of the opening 15, contact the mouth regions of the bores 9 and 10 of the lid parts 7 and 8. Upon further pivotal movement of the lid part 7 and 8, the radially elastic regions of the pegs 11, 12 with the largest diameter D are radially compressed when the lid parts 7 and 8 reach their closing position, the compressed regions of the pegs 11, 12 are located outside of the bore portions of the smaller bores 9 and 10 with a smaller diameter d and are able to expand. Thereby form-locking connections between the pegs 11, 12 and lid parts 7 and 8 is formed.

The wall thickness of the large-surface head 1 decreases toward its outer contour.

Though the present invention was shown and described with reference to the preferred embodiment, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A device for fastening an insulation element to a constructional component comprising a large-surface head (1); a hollow shank (2) projecting from the head (1) and having an inner space, which is freely accessible from an opening (15) provided in the head (1), for receiving a fastening member (3) drivable into the constructional element; and a lid (7, 8) supported on the head (1) and pivotable about an articulation axis (16, 17) located outside of the opening (15), for closing the opening, the lid engaging, in a closed position thereof, a projection extending from a head surface extending parallel to a cross-sectional surface of the hollow shank (2).

2. A device according to claim 1, wherein said head (1) having a recess (14) therein for receiving the lid (7,8) in the closed position thereof, said recess (14) having a bottom (13) extending transversely of said shank (2) and forming said head surface, and said lid (7, 8) at least partially surrounding the opening (15, 16).

3. A device according to claim 2, wherein the projection is formed by a peg projecting substantially perpendicular from the bottom (13) of the recess (14), the peg is form-lockingly extending into a through-bore (9, 10) formed in the lid.

4. A device according to claim 3, wherein the peg has a stepwisely enlarged portion facing a setting direction and tapers toward a free end thereof the peg having a largest diameter (2) thereof larger than a diameter of the through-bore (9,10).

5. A device according to claim 2, wherein the lid is formed of two lid parts (7,8) pivotally supported outside of opening (15) and pivotable about respective articulation axes (16, 17) extending parallel to each other.

6. A device according to claim 5, wherein at least two pegs (11, 12) are provided on the bottom (13) and each of the two lid parts (7,8) has at least one through-bore (9,10) in which a respective peg (11,12) engages.

* * * * *